United States Patent [19]

Hagmann et al.

[11] Patent Number: 5,067,611

[45] Date of Patent: Nov. 26, 1991

[54] BLISTER PACK FOR STORAGE OF NEEDLES AND THE LIKE

[75] Inventors: Paul Hagmann; Hermann Greven, both of Stolberg, Fed. Rep. of Germany

[73] Assignee: William Prym-Werke GmbH & Co. KG, Stolberg, Fed. Rep. of Germany

[21] Appl. No.: 534,739

[22] Filed: Jun. 7, 1990

[30] Foreign Application Priority Data

Jun. 21, 1989 [DE] Fed. Rep. of Germany .. 8907589[U]

[51] Int. Cl.[5] ..... B65D 85/24; B65D 73/00

[52] U.S. Cl. ..... 206/383; 206/380; 206/470; 206/471

[58] Field of Search ..... 206/470, 471, 380, 381, 206/383

[56] References Cited

U.S. PATENT DOCUMENTS

| | | | |
|---|---|---|---|
| 2,945,586 | 7/1960 | Mackes | 206/470 |
| 3,647,057 | 3/1972 | Ashmead et al. | 206/380 X |
| 4,155,454 | 5/1979 | Ryden | 206/470 X |
| 4,236,636 | 12/1980 | Kuchenbecker | 206/470 X |
| 4,243,141 | 1/1981 | Takahashi | 206/380 |
| 4,386,697 | 6/1983 | Zocher | 206/383 |
| 4,938,462 | 7/1990 | Gould | 206/470 |

FOREIGN PATENT DOCUMENTS

| | | | |
|---|---|---|---|
| 1786561 | 1/1975 | Fed. Rep. of Germany | 206/380 |
| 1919 | of 1898 | United Kingdom | 206/383 |
| 733048 | 7/1955 | United Kingdom | 206/383 |
| 1081927 | 9/1967 | United Kingdom | 206/470 |
| 1469404 | 4/1977 | United Kingdom . | |

*Primary Examiner*—William I. Price
*Attorney, Agent, or Firm*—Peter K. Kontler

[57] ABSTRACT

A pack for arrays of needles has a plate-like carrier with a hinge between its upper and lower sections, and a cover which overlies the front side of the carrier and has upper and lower sections connected to each other by a hinge. The lower sections are permanently bonded to each other around a field of parallel pockets for needles in one of the lower sections, and the upper sections are separably connected to each other to permit pivoting of such upper sections relative to each other in order to expose the needles. The upper sections can be recoupled to each other, and at least those portions of the cover which are adjacent the needles consist of a light-transmitting plastic material.

24 Claims, 5 Drawing Sheets

BLISTER PACK FOR STORAGE OF NEEDLES AND THE LIKE

BACKGROUND OF THE INVENTION

The invention relates to improvements in containers in general, and more particularly to improvements in receptacles (hereinafter called packs) for relatively small articles such as needles, pins and the like.

It is known to confine arrays of relatively small articles in so-called blister packs wherein a carrier member or backing member of cardboard or another material is sealingly connected with a cover member of light-transmitting plastic material. Examples of such blister packs are those which are used for storage and for displaying of batteries, tooth-brushes and many other products which are available for sale in hardware stores, drugstores, supermarkets, cigar stores and other establishments. As a rule, a blister pack is designed to permit convenient inspection of the confined article or articles as well as to afford convenient access for removal of discrete commodities or groups of several confined commodities.

British Pat. No. 14 69 404 discloses a blister pack which is used for the storage and for displaying of dressmakers' needles. The needles extend through a piece of textile material which is fastened to the rear side of a plate-like carrier member, and the needle-carrying portion of textile material extends forwardly through a window in the carrier member. A panel is used to overlie the textile material at the rear side of the carrier member, and such panel is affixed to the carrier member. The front side of the carrier member is adjacent a light-transmitting cover member of plastic material. The cover member is rigid but the carrier member has several parallel fold lines constituting rudimentary hinges along which portions of the carrier member can be flexed relative to the cover member to thus expose the articles. As an alternative, the patent proposes to cause a portion of the panel to extend forwardly through a window of the carrier member and to serve as a means for directly supporting the needles. To this end, each needle is caused to penetrate through two spaced-apart zones of the forwardly extending portion of the panel. In order to assemble the modified pack, it is necessary to first connect the needles to the forwardly projecting portion of the panel and to thereupon secure the preformed plastic cover member to the front side of the carrier member.

A drawback of the patented packs is that they are rather expensive. Moreover, it is quite difficult to remove selected needles from the piece of textile material or from the forwardly projecting portion of the panel, even after the carrier member is already flexed along a selected fold line so that a section of such folded carrier member extends away from the adjacent portion of the cover member. It is even more difficult to return a withdrawn needle into the pack, i.e., the patented packs are not suitable for renewed storage of needles after one or more uses.

OBJECTS OF THE INVENTION

An object of the invention is to provide a simple, inexpensive and highly versatile pack for storage of needles or other relatively small articles Another object of the invention is to provide a pack which can be readily manipulated to afford access to the confined articles and which is designed to permit convenient reinsertion or reintroduction of withdrawn articles.

A further object of the invention is to provide a pack which can be used for storage of arrayed articles, such as pins or needles, and which can be readily resealed or reclosed to safety confine the articles in its interior An additional object of the invention is to provide a novel and improved carrier member for use in the above outlined pack.

Still another object of the invention is to provide a novel and improved cover member for use in the above outlined pack.

A further object of the invention is to provide a pack which can be taken along in a bag or a suitecase wherein it occupies a miminum of space.

Another object of the invention is to provide a pack which can be displayed on existing supports in drugstores, supermarkets and other outlets for arrays of notions and the like.

An additional object of the invention is to provide a novel and improved method of assembling and manipulating the above outlined pack.

A further object of the invention is to provide a pack wherein the carrier member need not be provided with a plurality of fold lines.

Another object of the invention is to provide a pack which can receive and retain one or more reinserted articles with the same degree of reliability and safety as the originally inserted article or articles.

An additional object of the invention is to provide a pack which can be assembled from a minimal number of simple and inexpensive parts and which can be designed to serve as a rack for needles or analogous articles when the articles are accessible for withdrawal from the pack.

SUMMARY OF THE INVENTION

The invention is embodied in a pack for small articles, such as notions (examples of relatively small articles which can be confined in the improved pack are arrays of needles and analogous elongated articles). The improved pack comprises a substantially plate-like carrier member having first and second sections and a substantially straight weakened portion or hinge between the two sections, and a substantially plate-like cover member having first and second sections which are respectively adjacent the first and second sections of the carrier member. At least one second section has a plurality of article receiving pockets which open first ends adjacent and second ends remote from the weakened portion. The second sections have coherent portions which together form a substantially U-shaped frame surrounding the pockets and having free ends adjacent the weakened portion. The cover member has a second weakened portion or hinge between its first and second sections, and the first sections have portions which are separably connected to each other so that the first sections can be pivoted away from each other along the respective weakened portions to expose the open first ends of the pockets upon termination of separable connection between the separable portions of the first sections.

The pockets can constitute an undulate field with a first set of ridges adjacent the other second section and a second set of ridges alternating with the ridges of the first set and being remote from the other second section. The aforementioned coherent portions of the second sections are preferably in full surface-to-surface abutment with each other. The ridges of the first set of ridges can adhere to the other second section, and the carrier member can be provided with means (e.g., a suitably configurated hole) for facilitating suspension and displaying of the pack.

Portions of the articles can extend beyond the open first ends of the respective pockets, and the first section of one of the two members is then provided with a depression which defines with the other first section a chamber adjacent the weakened portions and receiving the extending portions of articles in the pockets. At least one of the two members preferably transmits light, at least in the region of the chamber, to permit observation of the articles.

The second sections can define a compartment which communicates with the second ends of the pockets, and at least one of the second sections preferably transmits light to permit observation of the contents of the compartment. A portion of the frame surrounds the compartment except at the second ends of the pockets.

At least one second section can be provided with a groove which communicates with the pockets, and such pack preferably further comprises a deformable insert which is confined in the groove and frictionally engages the articles in the pockets. If the pockets are elongated, the groove preferably extends transversely of the pockets. The insert is or can be made of an elastically deformable material.

The pack can further comprise a seal between the aforementioned portions of the first sections. Such seal is breakable to permit pivoting of at least one of the first sections away from the other first section along the respective weakened portion. The chamber for extending portions of the articles in the pockets is preferably disposed between the seal and the weakened portions of the two members.

The coherent portions of the second sections can be sealingly bonded to each other, e.g., by a bonding agent including a layer of lacquer between the coherent portions of the second sections.

The pack can further comprise means for separably coupling the first sections to each other. Such coupling means can comprise a deformable flap which is provided on one of the first sections and overlies a portion of the other first section. Alternatively, the coupling means can include the aforementioned seal if such seal consists of or contains a film of self-sealing adhesive between one or more portions of one first section and the adjacent portion or portions of the other first section. Such self-sealing adhesive can be relied upon to repeatedly establish a separable connection between the two first sections.

The carrier member can constitute a flat plate which is made of or contains cardboard; the cover member then preferably consists of light-transmitting plastic material and is provided with the aforementioned pockets, depression, compartment and groove. The second weakened portion of such pack preferably comprises readily foldable ends, e.g., ends comprising troughs having bottom portions which are remote from the carrier member.

Alternatively, the cover member can constitute a substantially flat plate of light-transmitting material and the pockets can be provided in the carrier member. The weakened portion of such carrier member can be provided with readily foldable ends, e.g., with ends including troughs having bottom portions which are remote from the cover member.

One of the first sections can be provided with a recess and the other first section of such pack preferably includes a marginal portion which overlies the recess. The recess is accessible to a finger or to a tool to facilitate engagement of the marginal portion for the purpose of pivoting at least one of the first sections along the respective weakened portion.

The novel features which are considered as characteristic of the invention are set forth in particular in the appended claims. The improved pack itself, however, both as to its construction and the mode of using the same, together with additional features and advantages thereof, will be best understood upon perusal of the following detailed description of certain specific embodiments with reference to the accompanying drawing.

DESCRIPTION OF PREFERRED EMBODIMENTS

Figure 1:
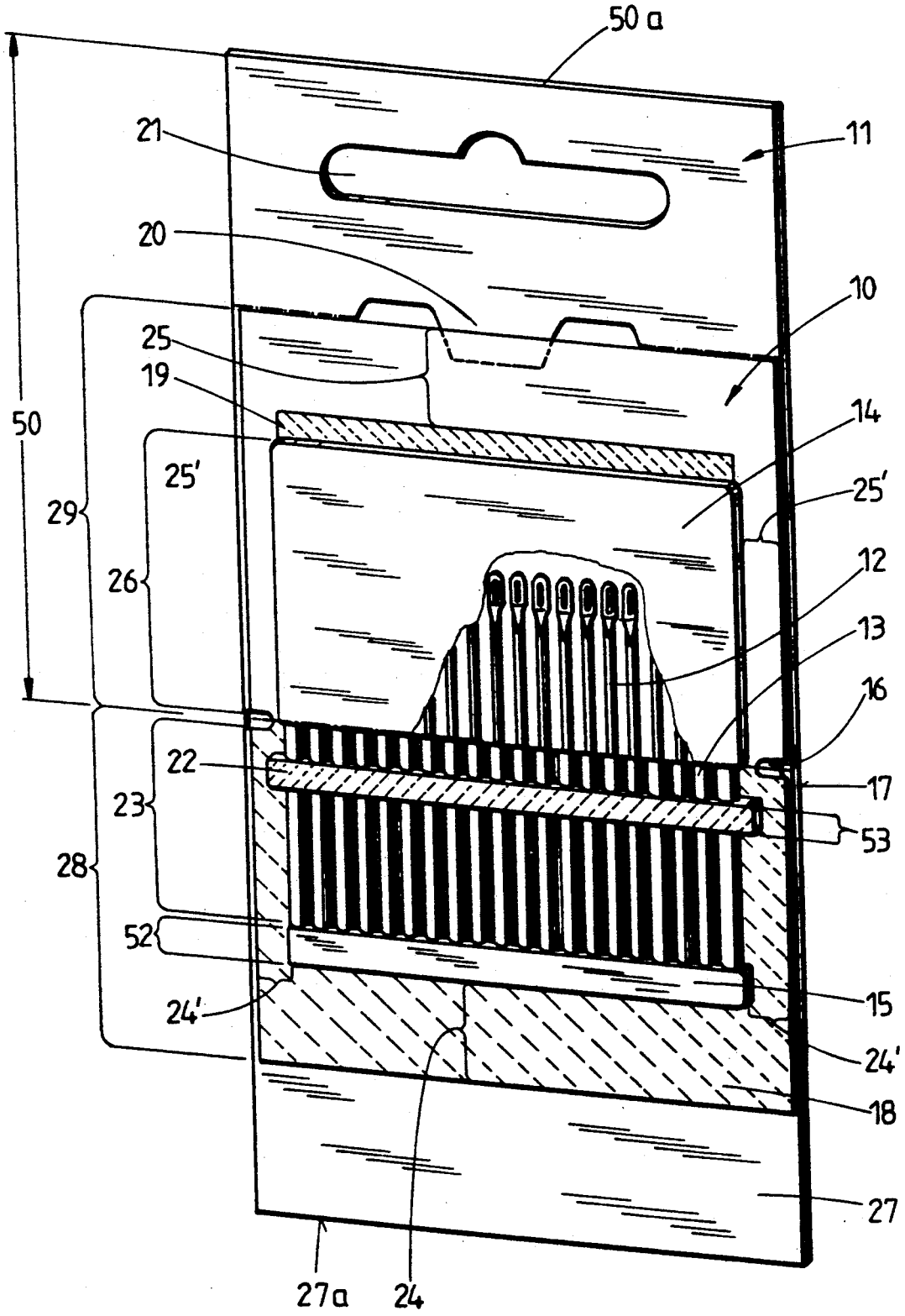
FIG. 1 is front perspective view of a blister pack which embodies one form of the invention and wherein the first sections of the cover member and the carrier member are sealingly coupled to each other.
Figure 2:
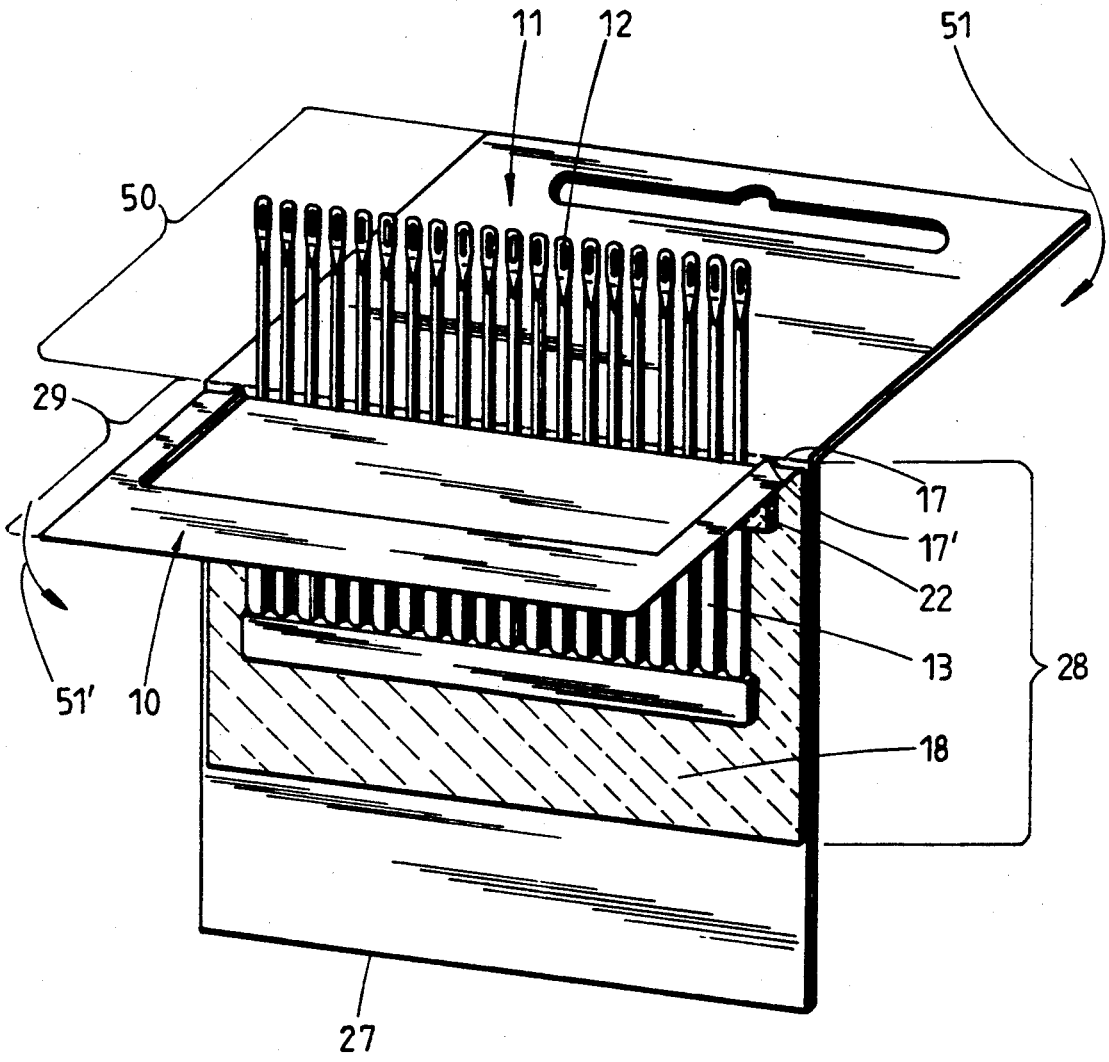
FIG. 2 is a perspective view showing the pack of FIG. 1 in open position with the first sections of the cover member and carrier member pivoted away from each other to expose the extending portions of articles in the pockets of the second section of the cover member.
Figure 3:
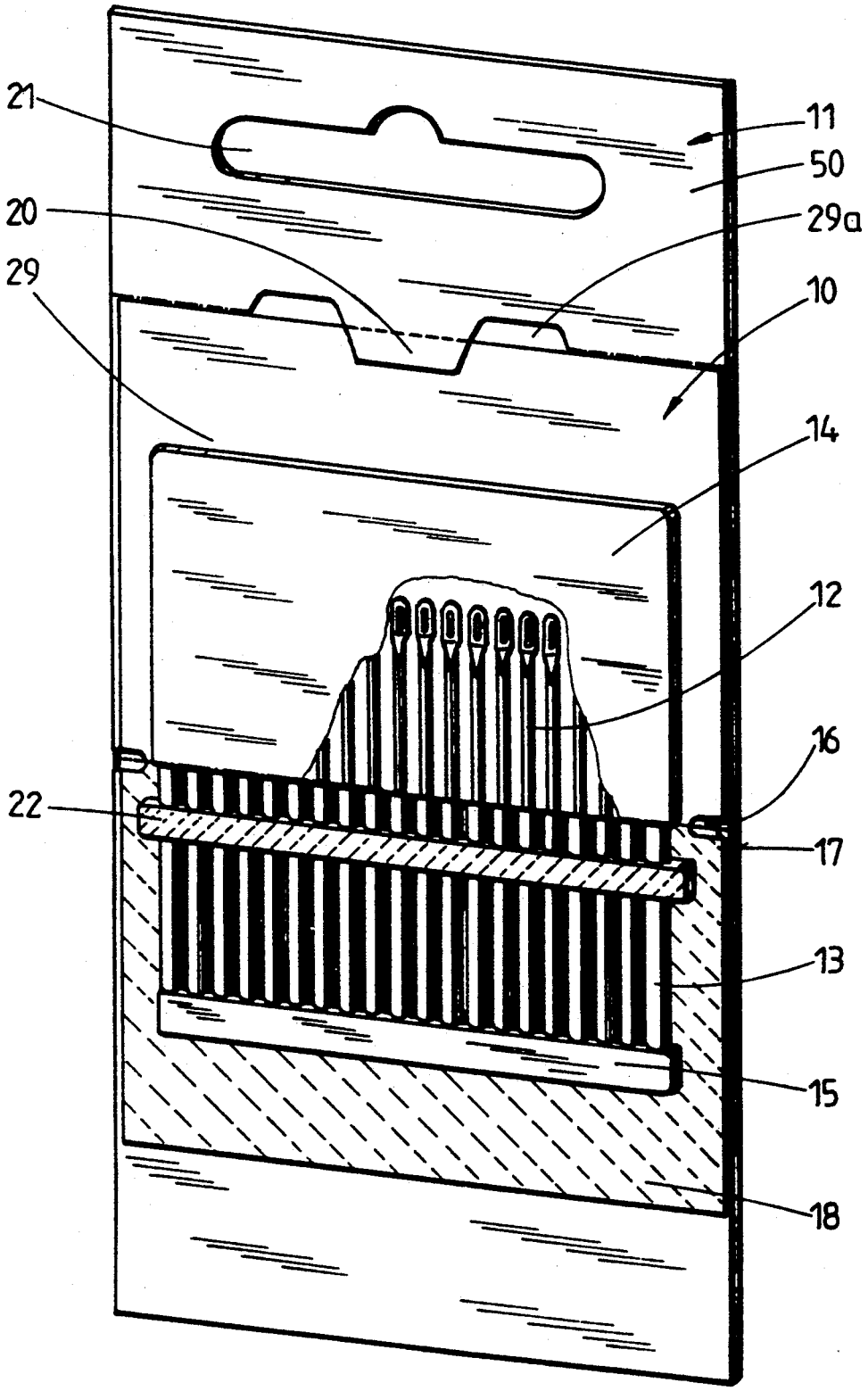
FIG. 3 is a perspective view similar to that of FIG. 1, the first section of the cover member being separably recoupled to the first section of the carrier member.

The pack which is shown in FIGS. 1 to 3 comprises a rectangular flat plate-like carrier member 11 of cardboard or the like, and a plastic cover member 10 of light-transmitting material, e.g., a transparent thermoplastic foil. FIG. 1 shows the front sides of the members 10 and 11 as well as an array of elongated rod-like articles 12 (such as dressmakers' needles) which are partially confined in elongated parallel pockets 13 provided therefor in a lower (second) section 28 of the cover member 10. The front side of the carrier member 11 is or can be provided with information pertaining to the articles 12 and/or to the maker and/or distributor of the articles. For example, the carrier member 11 can be provided with information pertaining to the sizes of the articles 12, the cost of the pack, instructions to use, remove or reinsert the articles, the name and trademark of the manufacturer and/or other data.

The pockets 13 for the articles 12 are parallel to and are equally spaced apart from each other so as to permit convenient grasping of those portions of the articles which extend beyond the open upper ends of the pockets 13 and into a chamber 14 which is defined by a flat and shallow depression in the first or upper section 29 of the cover member 10 in conjunction with the adjacent part of the first or upper section 50 of the carrier member 11. The cover member 10 is a foil or sheet which is shaped under the action of heat to form several blisters including those constituting the pockets 13 and a further blister constituting the depression for the making of the chamber 14. Once the sheet which is to be converted into the cover member 10 is adequately heated, it can be readily shaped (e.g., by deep drawing) in a suitable form or mold in accordance with any one of a number of well known procedures not forming part of the invention.

The pockets 13 together form a rectangular field 23 which is adjacent a weakened portion or hinge 17' (FIG. 2) between the first and second sections 29, 28 of the cover member 10, and such weakened portion 17' is adjacent and parallel to a weakened portion or hinge 17 between the first and second sections 50, 27 of the carrier member 11. The field 23 is composed of undulations having a first set of ridges which abut or are closely adjacent ad can be bonded to the front side of the second section 27, and a second set of ridges which alternate with the ridges of the first set and are spaced apart from the front side of the section 27. The depression (chamber 14) is formed in a rectangular field 26 which forms part of the section 29 and is adjacent the weakened portion 17'.

The field 23 including the pockets 13 is surrounded by a U-shaped frame 18 including two parallel portions 24' which terminate at the weakened portion 17' and a wide portion 24 which extends between the portions 24'. The frame 18 including the portions 24, 24' is permanently secured (particularly bonded) to the adjacent portion of the section 27 and surrounds all sides of the field 23 except at the open ends of the pockets 13 in the region of the weakened portion 17'.

When the improved pack is ready for sale, two portions 25' of the first section 29 merely abut the adjacent portions of the first section 50, and a portion 25 of the first section 29 also merely abuts the adjacent portion of the section 50 with the exception of a relatively narrow elongated strip-shaped coupling portion 19 forming part of the portion 25 and being separably secured to adjacent portion of the section 50, e.g., by a layer or self-sealing adhesive or any other adhesive. Thus, the sections 50, 29 can be readily separated from each other but coherent portions of the sections 27, 28 preferably permanently adhere to each other (at 24, 24') irrespective of the selected mutual inclination of the sections 50 and 29.

Those ends of the pockets 13 which are remote from the weakened portion 17' preferably communicate with an elongated compartment 15 which is surrounded by the frame 18 and can receive the sharp tips of the articles 12. The compartment 15 is defined by a forwardly projecting shallow depression 52 of the section 28 in conjunction with adjacent portion of the section 27. Since the material of the cover member 10 transmits light, a potential purchaser or the owner of the pack can readily observe the tips of the articles 12 irrespective of the positions of sections 50, 29 relative to each other. The sections 50, 27 can be pivoted relative to each other along the weakened portion 17 (e.g., a rudimentary hinge including a creased portion of the member 11), and the sections 29, 28 are pivotable relative to each other along the weakened portion 17'. Each pocket 13 can serve as a receptacle or container for a single article 12 or for two or more articles; the drawing shows that each pocket 13 contains a portion of a single article 12.

The feature that the frame 18 of the section 28 is permanently bonded to the adjacent portion of the section 27 contributes to stability and reliability of the pack.

The portions 25, 25' of the section 29 also constitute a substantially U-shaped or C-shaped frame which is only partially bonded to the section 50, as at 19; however, the seal 19 can be readily destroyed to permit pivoting of the section 50 relative to the section 29 and/or pivoting of the section 29 relative to the section 50. The integrity of the seal 19 is an indicator of integrity of the improved pack, i.e., it denotes that the articles 12 are originally packed and were not used or exchanged by an unauthorized or any other person. The seal 19 is sufficiently small and weak to be capable of being destroyed with a minimum of effort.

FIG. 2 shows the pack of FIG. 1 in open position in which those portions of the articles 12 that extend beyond the open upper ends of the respective pockets 13 are readily accessible for withdrawal from the field 23. The first or upper section 50 of the carrier member 11 has been pivoted in a clockwise direction (arrow 51) through an angle of approximately 90°, and the first section 29 has been pivoted in a counterclockwise direction (arrow 51') through an angle of approximately 90° so that the thus pivoted sections 50 and 29 are located in or close to a common plane extending substantially at right angles to the common plane of the sections 27 and 28.

In order to facilitate pivoting of the section 29 along the weakened portion 17', the two ends 16 of this weakened portion are preferably designed to facilitate ready pivoting of the section 29 relative to the section 28 and/or vice versa. To this end, the ends 16 of the weakened portion 17' resemble or constitute relatively short grooves which are open at the respective edges of the cover member 10 and have bottom zones which are remote from the front side of the carrier member 11. Pivoting of the sections 50, 29 to the positions of FIG. 2 must be preceded by breakage or destruction of the seal 19. Those portions of the cover member 10 which define the grooves 16 at the ends of the weakened portion 17' have a substantially U-shaped cross-sectional outline with the web or bight of the U remote from the weakened portion 17 of the carrier member 11. The ends 16 can constitute the entire weakened portion 17' and are preferably formed simultaneously with the pockets 13, depression for the chamber 14 and depression 52 for the compartment 15.

The user of the pack can position the opened pack of FIG. 2 on a suitable support (e.g., a table or desk) in such a way that the support abuts the edges 50*a*, 27*a* of the sections 50, 27 of the carrier member 11. The extending portions of the articles 12 are fully accessible, i.e., each such article can be individually removed from or reinserted into the corresponding pocket 13 or into any unoccupied pocket.

If the pack of FIGS. 1 and 2 is to be put back to storage or simply closed so that the articles 12 are fully confined between the members 10 and 11, the sections 50 and 29 are pivoted toward and against each other to assume the positions which are shown in FIG. 3. If the nature of adhesive forming the seal 19 is such that it can repeatedly bond the respective portions of the sections 50, 29 to each other, it is merely necessary to press the sections 50, 29 against one another so that the seal 19 is reestablished and maintains the neighboring sides or surfaces of the sections 50, 29 in abutment with or rather close to each other. Alternatively, or in addition to such seal, the means for separably coupling the section 50, 29 to each other can comprise a prefabricated flap 20 which is formed in the section 50 and can be flexed to overlie the adjacent portion of the edge 29*a* of the section 29 in a manner as shown in FIG. 3. This ensures that the pack reassumes a flat shape in which it occupies a minimum of space, e.g., in a purse, in a bag, in a drawer or in another place where the pack is held when not in use. The flap 20 of the separable coupling is preferably formed during making of the carrier member 11. This flap constitutes but one form of coupling means which can be used to establish a readily and repeatedly separable connection between the sections 50, 29 when the pack is not in use. For example, the user can employ a piece of adhesive tape, a paper clip or any other rudimentary coupling means.

The purpose of a slot-shaped opening 21 in the first section 50 of the carrier member 11 is to facilitate suspension on supports of the type used in many self-service establishments wherein the customer slides the pack off the support (e.g., an elongated arm of wire or the like) and carries it to the checkout counter. When the pack is suspended on an arm or a like support which extends through the opening 21, the front side of the pack is readily observable by a customer and the transparent or translucent cover member 10 renders it possible to observe the articles 12 in the pockets 13 and in the chamber 14. If the articles 12 are dressmakers' needles, their eyes are preferably located in the chamber 14 and their tips extend from the respective pockets 13 into the compartment 15.

The section 28 of the carrier member 10 is further provided with an elongated and relatively narrow groove 53 which extends transversely of and communicates with intermediate portions of the pockets 13. This groove confines an elastically deformable strip-shaped insert 22 of felt or other suitable material which is maintained in pronounced frictional engagement with median portions of the articles 12. The groove 53 is or can be parallel to the weakened portions 17, 17' and is or can be at least substantially filled with the material of the insert 22. The purpose of the insert 22 is to frictionally engage and hold the articles 12 against angular as well as against axial movements relative to the respective pockets 13. The arrangement may be such that the insert 22 biases the adjacent portions of the articles 13 against the internal surfaces of the respective pockets or against the front side of the second section 27 of the carrier member 11. The provision of such insert is desirable and advantageous when the articles 12 are needles or like objects which can be maintained in any one of a plurality of different angular positions and which are likely to move axially if not adequately held against such movement. The insert 22 renders it possible to dispense with stops for the eyes and/or tips of articles 12 in the form of needles or the like, i.e., the array of articles remains in the eye-pleasing position in which it has been introduced into the pockets 13 even though the pack need not be provided with stops for the ends of the articles. Such stops could interfere with observation of entire articles behind the cover member 10.

The first sections 50, 29 of the members 11, 10 can be pivoted relative to each other and relative to the second sections 27, 28 beyond the positions which are shown in FIG. 2, i.e., through angles of more than 90°.

An advantage of the improved pack is that it consists essentially of two parts, namely the members 10 and 11. The insert 22 is desirable but optional. Such pack can be produced at a low cost in available machines. The assembly of the members 10, 11 is a simple procedure which does not take up much time, and the same holds true for insertion of the articles 12. Such articles can be inserted into their pockets 13 while the sections 27, 28 are already bonded to each other and while the sections 29, 50 are held in the positions of FIG. 2. The seal 19 is established subsequent to insertion of the articles.

Figure 4:
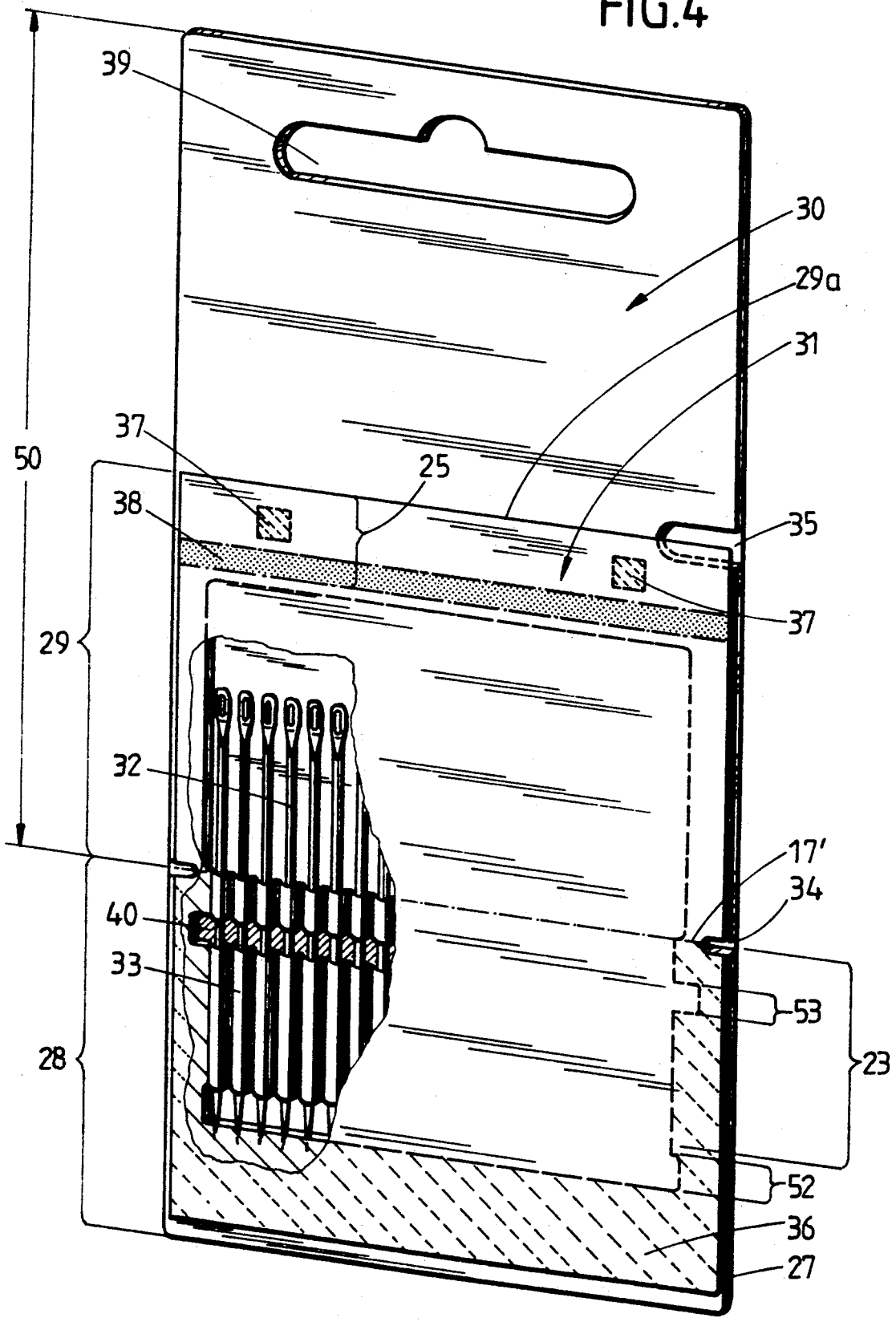
FIG. 4 is a perspective view of a second blister pack with the first sections of the cover member and carrier member sealingly but separably coupled to each other.
Figure 5:
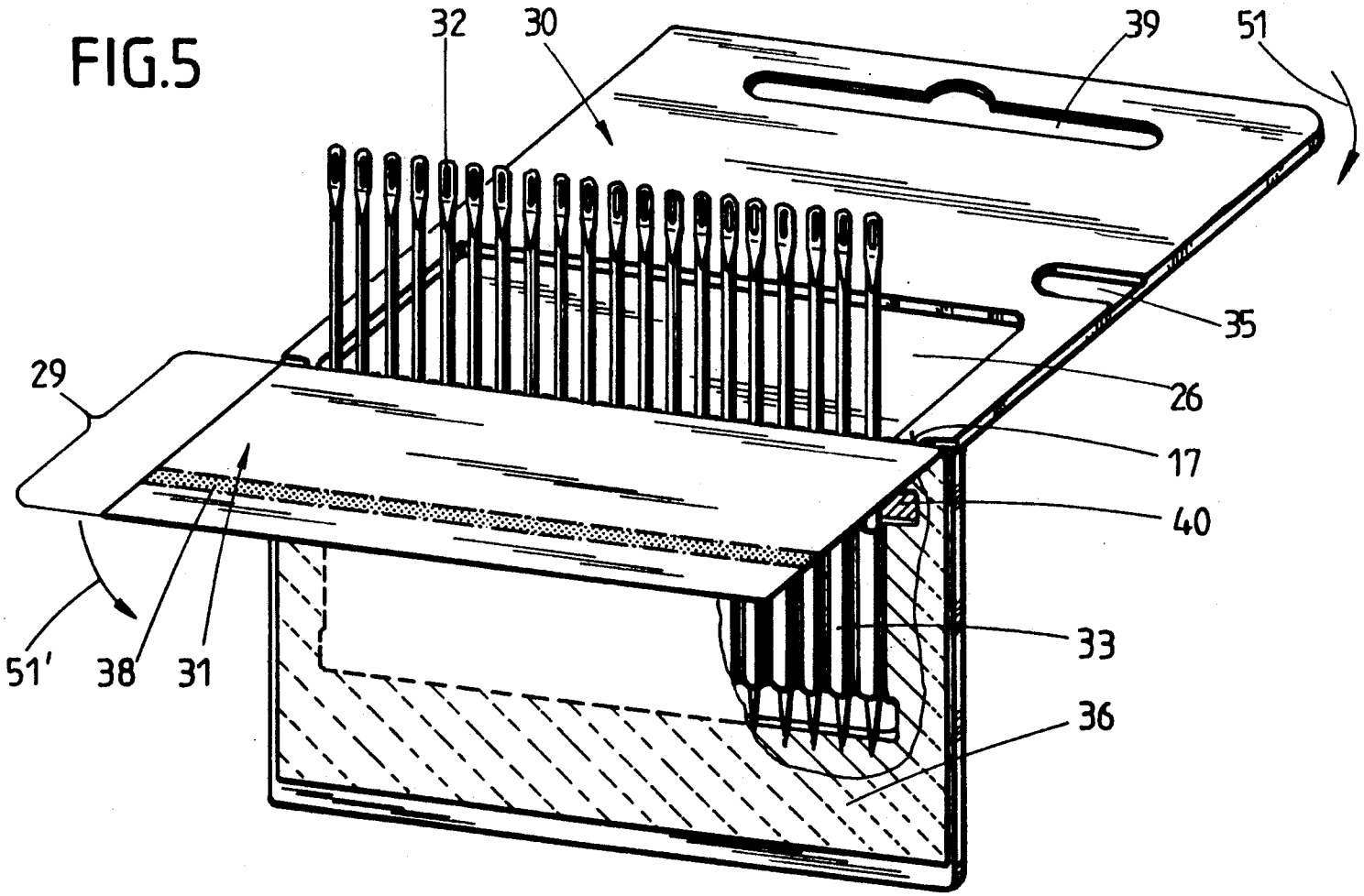
FIG. 5 is a perspective view showing the pack of FIG. 4 in open position in which the extended portions of articles are readily accessible for withdrawal from their respective pockets.

FIGS. 4 and 5 show a modified pack wherein all such parts which are identical with or clearly analogous to corresponding parts of the pack of FIGS. 1 to 3 are denoted by similar reference characters. The carrier member 30 of the pack of FIGS. 4 and 5 is made of a thermoplastic material which is deformable in response to heating so as to be provided with pockets 33 for elongated articles 32. The cover member 31 is a substantially flat plate which is preferably made of a light-transmitting (e.g., transparent) plastic material and overlies a substantial part of the carrier member 30 prior to opening of the pack, i.e., prior to breaking of a seal 37, 38 between selected portions of the first section 50 of the carrier member 30 and selected portions of the first section 29 of the cover member 31. The field 23 is part of the second section 27 of the carrier member 30 and includes the pockets 33 for the needles 32. The U-shaped frame 36 which is composed of coherent portions of the sections 27, 28 is similar to the frame 18 and surrounds the field 23 as well as the compartment including the depression 52 of the section 27 for the tips of the articles 32.

The seal between selected portions of the sections 50, 29 includes an elongated strip 38 which must be destroyed prior to pivoting of at least one of the sections 50, 29 relative to the other section, and two relatively small spots 37 of self-sealing adhesive which can be used in lieu of the flap 20 as a means for separably and repeatedly coupling the sections 50, 29 to each other. Alternatively, the spots 37 can serve as an indicator that the pack of FIGS. 4 and 5 is still intact, i.e., the seals in the regions of these spots must be broken in order to enable the user to pivot the section 50 relative to the section 29 and/or to pivot the section 29 relative to the section 50. The portions 38 then carry a film of self-sealing adhesive which serves as a rudimentary coupling in that it permits repeated separation of the sections 50, 29 from each other and renewed attachment of such sections to one another.

The positions to which the sections 50, 29 of the members 30, 31 can be pivoted relative to each other and relative to the respective second sections 27, 28 are shown in FIG. 5. Such pivoting takes place along the weakened portion 17 and/or along the weakened portion 17'.

The ends 34 of the weakened portion 17 in the carrier member 30 define two aligned grooves which are open at the respective edges of the carrier member and facilitate predictable pivoting of the sections 50, 27 relative to each other. The carrier member portion in the regions of the ends 34 has a substantially U-shaped cross-sectional outline. The section 50 of the carrier member 30 has a shallow depression 26 which receives the extending portions of articles 32 in closed position of the member 30. The compartment including the depression 52 is provided in the section 27 of the carrier member 30. Still further, the section 27 is formed with a groove 53 which is parallel to the weakened portions 17, 17' and receives an elastically deformable insert 40 (e.g., a strip made of felt or a like material) which serves to frictionally engage the adjacent median portions of the articles 32 in the respective pockets 33 in order to prevent uncontrolled axial and/or angular movements of the articles.

The section 50 of the carrier member 30 has a slot-shaped opening 39 to facilitate suspension on an arm in a store or at home. Furthermore, the section 50 has a marginal recess 35 which is at least partially overlapped by the adjacent edge portion 29*a* of the section 29 when the latter abuts the section 50. The recess 35 provides room for insertion of a finger or of a tool to facilitate destruction of the seal including the spots 37 and separation of the sections 50, 29 along the self-sealing strip 38 preparatory to pivoting of the section 50 away from the section 29 and/or preparatory to pivoting of the section 29 away from the section 50. The exposed parts of the articles 32 are accessible as soon as the section 50 is pivoted relative to the section 27 in order to move the section 50 out of the plane of the section 27, i.e., to pivot the depression 26 away from exposed portions of the articles 32. These articles are even more readily accessible if the section 29 is pivoted relative to the section 28 along the weakened portion 17′ because this moves the section 29 away from those portions of the articles 32 which extend from the open upper ends of the pockets 33.

The improved pack is susceptible of many additional modifications. For example, each of the members 10, 11 or 30, 31 can be provided with pockets 13 or 33, a depression for a window 14 or a depression 26, a groove 53 and a compartment 15. At least the pockets can consist of mirror symmetrical halves, one in the carrier member and the other in the cover member. Furthermore, the finished pack need not have a rectangular outline.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A pack for small articles, such as notions, particularly for arrays of parallel needles and analogous elongated articles, comprising a substantially plate-like carrier member having first and second sections and a substantially straight first weakened portion between said sections; and a substantially plate-like cover member having first and second sections respectively adjacent the first and second sections of said carrier member, at least one of said second sections having a plurality of article-receiving pockets with open first ends adjacent and second ends remote from said weakened portion, said second sections having coherent portions together forming a substantially U-shaped frame which surrounds said pockets and has free ends adjacent said weakened portion, said cover member having a second weakened portion between said first and second sections thereof and said first sections having portions separably connected to each other so that said first sections can be pivoted away from each other along the respective weakened portions to expose the open first ends of said pockets upon termination of separable connection between said portions thereof.

2. The pack of claim 1, wherein said pockets together form an undulate field with a first set of ridges adjacent the other of said second sections and a second set of ridges alternating with the ridges of said first set and remote from said other second section, said portions of said second sections being in substantially full surface-to-surface abutment with each other.

3. The pack of claim 2, wherein the ridges of said first set adhere to said other second section.

4. The pack of claim 1, wherein the first section of said carrier member has means for facilitating suspension and displaying of the pack.

5. The pack of claim 1 for articles having portions which extend beyond the open first ends of and from said pockets, wherein the first section of one of said members has a depression defining with the other first section a chamber adjacent said weakened portions and receiving the extending portions of articles in said pockets, at least one of said members transmitting light in the region of said chamber to permit observation of the articles.

6. The pack of claim 1, wherein said second sections of said members define a compartment which communicates with the second ends of said pockets and at least one of said second sections transmits light to permit observation of the compartment.

7. The pack of claim 6, wherein said frame has a portion which surrounds said compartment except at the second ends of said pockets.

8. The pack of claim 1, wherein at least one of said second sections has a groove communicating with said pockets and further comprising a deformable insert confined in said groove and frictionally engaging the articles in said pockets.

9. The pack of claim 8, wherein said pockets are elongated and said groove extends transversely of said elongated pockets, said insert being elastically deformable.

10. The pack of claim 1, further comprising a seal between said portions of said first sections, said seal being breakable to permit pivoting of at least one of said first sections away from the other first section along the respective weakened portion.

11. The pack of claim 1, wherein said first sections define a chamber which is adjacent the open first ends of said pockets and is accessible upon pivoting of at least one first section away from the other first section subsequent to breaking of said seal, said chamber being disposed between said weakened portions and said seal.

12. The pack of claim 1, wherein said coherent portions of said second sections are sealingly bonded to each other.

13. The pack of claim 12, comprising a layer of lacquer between said coherent portions of said second sections.

14. The pack of claim 1, further comprising means for separably coupling said first sections to each other.

15. The pack of claim 14, wherein said coupling means includes a deformable flap provided on one of said first sections and overlying a portion of the other first section.

16. The pack of claim 14, wherein said coupling means comprises a film of self-sealing adhesive between said portions of said first sections.

17. The pack of claim 1, wherein said carrier member is a flat plate and said cover member consists of light-transmitting plastic material, said pockets being provided in said cover member.

18. The pack of claim 17, wherein said carrier member contains cardboard.

19. The pack of claim 17, wherein said second weakened portion has readily foldable ends.

20. The pack of claim 19, wherein said readily foldable ends include troughs having bottom portions which are remote from said carrier member.

21. The pack of claim 1, wherein said cover member is a substantially flat plate of light-transmitting material, said pockets being provided in said carrier member.

22. The pack of claim 21, wherein said first weakened portion has readily foldable ends.

23. The pack of claim 22, wherein said readily foldable ends include troughs having bottom portions which are remote from said cover member.

24. The pack of claim 1, wherein one of said first sections has a recess and the other of said first sections has a marginal portion overlying said recess, said recess being accessible to facilitate engagement of said marginal portion for the purpose of pivoting at least one of said first sections along the respective weakened portion.

* * * * *